US009956802B2

(12) United States Patent
Imakura

(10) Patent No.: US 9,956,802 B2
(45) Date of Patent: May 1, 2018

(54) THERMAL TRANSFER SHEETS

(71) Applicant: DAI NIPPON PRINTING CO., LTD., Tokyo-to (JP)

(72) Inventor: Yuzu Imakura, Tokyo-to (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 0 days. days.

(21) Appl. No.: 15/393,422

(22) Filed: Dec. 29, 2016

(65) Prior Publication Data

US 2017/0190202 A1 Jul. 6, 2017

(30) Foreign Application Priority Data

Jan. 6, 2016 (JP) ..... 2016-001266

(51) Int. Cl.
*B41M 5/382* (2006.01)
*B41M 5/395* (2006.01)
*B41M 5/44* (2006.01)

(52) U.S. Cl.
CPC ..... *B41M 5/38214* (2013.01); *B41M 5/395* (2013.01); *B41M 5/44* (2013.01); *B41M 2205/02* (2013.01); *B41M 2205/06* (2013.01); *B41M 2205/30* (2013.01); *B41M 2205/38* (2013.01); *B41M 2205/40* (2013.01)

(58) Field of Classification Search
CPC .. B41M 5/382; B41M 5/38214; B41M 5/395; B41M 5/44; B41M 2205/04; B41M 2205/06; B41M 2205/30; B41M 2205/38; B41M 2205/40
USPC ..... 428/32.79, 32.81, 32.86
See application file for complete search history.

(56) References Cited

FOREIGN PATENT DOCUMENTS

JP H11-321116 A 11/1999

*Primary Examiner* — Bruce H Hess
(74) *Attorney, Agent, or Firm* — Oliff PLC

(57) ABSTRACT

The thermal transfer sheet according to the present invention that has in the order mentioned, a substrate, a release layer, a colored layer, and an adhesion layer; and is characterized in that the colored layer contains a colorant and a polyester-based resin; the adhesion layer contains a polyester-based resin; a ratio of the thickness of the release layer to the total thickness of the colored layer and the adhesion layer (the thickness of the release layer/(the thickness of the colored layer+the thickness of the adhesion layer)) is not less than 2/3 and not more than 3/2; and the total thickness of the release layer, the colored layer, and the adhesion layer is not less than 1.0 μm and not more than 2.0 μm.

5 Claims, 2 Drawing Sheets

[FIG. 1]
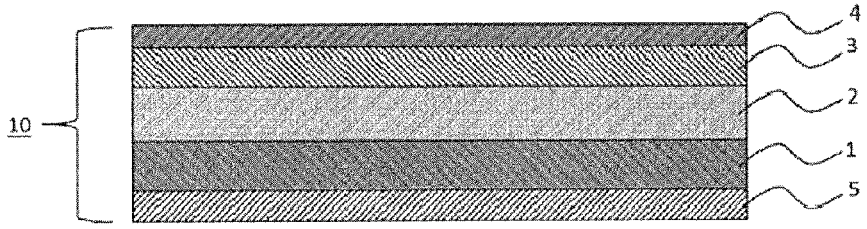
[FIG. 2]
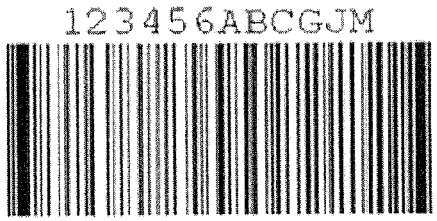
[FIG. 3]
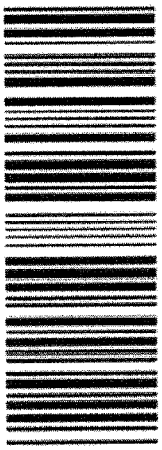

[FIG. 4]
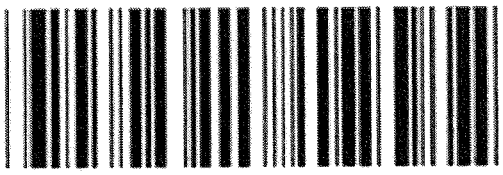

THERMAL TRANSFER SHEETS

BACKGROUND OF THE INVENTION

Field of the Invention

The present invention relates to thermal transfer sheets that exhibit excellent resistance to organic solvents, excellent printability to a material on which a print is to be applied having unevenness in its surface, and excellent printability for fine lines, which thermal transfer sheets are capable of preventing failures of transfer such as tailing from occurring.

Background Art

A thermofusible transfer system is conventionally known as a printing system using a thermal transfer sheet, which thermofusible transfer system uses a thermal transfer sheet that is carried a colored layer obtained by dispersing a colorant such as a pigment or a dye in wax or a resin on a substrate such as a plastic film. The colored layer is transferred onto a material on which a print is to be applied such as paper or a plastic sheet by applying energy depending on image information using a heating device such as a thermal head. Printing image formed by the thermofusible transfer system has high density and exhibits excellent sharpness and are suitable for recording binary format image such as letters and line drawing.

In addition, according to the thermofusible transfer system, variable information typified by attribute information such as addresses, customer information, numbering, and barcodes can be readily output to and recorded in the material on which a print is to be applied using a computer and a heat transfer printer.

Such a thermal transfer sheet is required to have high adhesiveness to the material on which a print is to be applied and high printability for fine lines. In addition, it is required to prevent failures of transfer such as tailing from occurring at the time of the transfer.

In order to meet the requirement, Patent Document 1 has disclosed a thermal transfer sheet comprising, in the order mentioned, a release layer, a colored layer, and an adhesion layer on its support, wherein the adhesion layer contains a polyester-based resin whose glass transition temperature is not less than 70° C. and not more than 80° C.

Further, in cases where the thermal transfer sheet is used in the environment in which an organic solvent like isopropyl alcohol (IPA) is used, what is required is that letters and the like which are formed by the transfer of the colored layer are not erased by the use of the organic solvent. That is, the thermal transfer sheet is required to have resistance to organic solvents.

However, conventional thermal transfer sheets including the thermal transfer sheet disclosed in Patent Document 1 do not have adequate adhesiveness between the adhesion layer and the material on which a print is to be applied. The adhesion layer does not closely contact with the colored layer in an adequate manner either. The organic solvent seeps in those gaps. Thus, there was room for improvement in terms of the resistance to organic solvents.

In addition, some of the materials on which a print is to be applied have unevenness on their surface; and the thermal transfer sheet is required to have high printability even to the material on which a print is to be applied having unevenness in its surface. Yet, the thermal transfer sheet disclosed in Patent Document 1 did not have adequate printability to a material on which a print is to be applied having unevenness in its surface.

PRIOR ART REFERENCES

Patent Document

Patent Document 1: Japanese Patent Application Laid-Open Publication No. 11-321116

SUMMARY OF THE INVENTION

Problems to be Solved by the Invention

The present inventors have recently discovered that, in a thermal transfer sheet comprising, in the order mentioned, a substrate, a release layer, a colored layer, and adhesion layer, by adjusting a ratio of the thickness of the release layer to the total thickness of the colored layer and the adhesion layer, and the total thickness of the release layer, the colored layer, and the adhesion layer to a specific range, and in addition by including a polyester-based resin in the colored layer and the adhesion layer, the resistance to organic solvents of the thermal transfer sheet is able to be significantly improved.

They have also discovered that, according to this thermal transfer sheet, it is possible to perform fine line printing without causing faint print and collapsed print, that is, to improve the printability for fine lines, and to prevent failures of transfer such as tailing from occurring.

Further, they have discovered that printability to a material on which a print is to be applied having unevenness on its surface is also excellent.

Therefore, an object of the present invention is to provide thermal transfer sheets that exhibit excellent resistance to organic solvents, excellent printability to a material on which a print is to be applied having unevenness in its surface, and excellent printability for fine lines, which thermal transfer sheets are capable of preventing failures of transfer such as tailing from occurring.

Means for Solving the Problems

The thermal transfer sheet according to the present invention that comprises, in the order mentioned, a substrate, a release layer, a colored layer, and an adhesion layer; and is characterized in that the colored layer comprises a colorant and a polyester-based resin;

the adhesion layer comprises a polyester-based resin;

a ratio of the thickness of the release layer to the total thickness of the colored layer and the adhesion layer (the thickness of the release layer/(the thickness of the colored layer+the thickness of the adhesion layer)) is not less than 2/3 and not more than not more than 3/2; and the total thickness of the release layer, the colored layer, and the adhesion layer is not less than 1.0 μm and not more than 2.0 μm.

In the above aspect, the thickness of the colored layer is preferably not less than 0.2 μm and not more than 0.8 μm.

In the above aspect, the colored layer preferably comprises the polyester-based resin A having a number average molecular weight of not less than 15,000 and the polyester-based resin B having a number average molecular weight of not more than 5,000.

In the above aspect, a content ratio by mass of the polyester-based resin A to the polyester-based resin B (polyester-based resin A/polyester-based resin B) in the colored layer is preferably not less than 2/3 and not more than 9/1.

In the above aspect, the number average molecular weight of the polyester-based resin contained in the adhesion layer is preferably not less than 2,000 and not more than 25,000.

Effect of the Invention

According to the present invention, thermal transfer sheets having high resistance to organic solvents are able to be provided, wherein letters and the like formed by transferring the colored layer are not erased by an organic solvent.

In addition, what is able to be provided are thermal transfer sheets that exhibit excellent printability to a material on which a print is to be applied having unevenness in its surface, printability for fine lines, and are capable of preventing failures of transfer such as tailing from occurring.

BRIEF DESCRIPTION OF THE DRAWINGS

FIG. 1 is a schematic cross sectional view showing one embodiment of the thermal transfer sheet of the present invention.

FIG. 2 is a figure showing a print pattern used in the evaluation for printability for fine lines in Examples.

FIG. 3 is a figure showing a print pattern used in the evaluation for tailing in Examples.

FIG. 4 is a figure showing a print pattern used in evaluation for resistance to organic solvents in Examples.

MODE FOR CARRYING OUT THE INVENTION (Thermal Transfer Sheet)

As shown in FIG. 1, the thermal transfer sheet 10 according to the present invention comprises, in the order mentioned, the substrate 1, the release layer 2, the colored layer 3 that contains a colorant and a polyester-based resin, and the adhesion layer 4 that contains a polyester-based resin.

Further in one embodiment, the thermal transfer sheet 10 may comprise the backing layer 5 on the other surface of the substrate 1, the surface being opposed to the surface that is provided with the release layer 2 and the like.

In the thermal transfer sheet according to the present invention, a ratio of the thickness of the release layer to the total thickness of the colored layer and the adhesion layer (the thickness of the release layer/(the thickness of the colored layer+the thickness of the adhesion layer)) is not less than 2/3 and not more than 3/2.

Further, a ratio of the thickness of the release layer to the total thickness of the colored layer and the adhesion layer is more preferably not less than 3/4 and not more than 1.

Further in the thermal transfer sheet according to the present invention, the total thickness of the release layer, the colored layer, and the adhesion layer is preferably not less than 1.0 μm and not more than 2.0 μm and more preferably not less than 1.2 μm and not more than 1.6 μm.

By adjusting a ratio of the thickness of the release layer to the total thickness of the colored layer and the adhesion layer and the total thickness of the release layer, the colored layer, and the adhesion layer to the above range of numerical values and by including a polyester-based resin in the colored layer and the adhesion layer, it is possible to improve resistance to organic solvents and thermal transfer sheet's printability for fine lines and printability to a material on which a print is to be applied having unevenness in its surface, and to concurrently prevent failures of transfer from occurring.

In the present invention, the thickness of each of the layers composed of the thermal transfer sheet was measured using a resin embedding method.

To be specific, a thermal transfer sheet (specimen) was excised and then embedded in an epoxy resin; a cross section was formed by cutting the specimen in its thickness direction by an ultra thin sectioning method (cutting with a microtome and a diamond cutter); this cross section was subjected to ion sputtering (manufactured by Hitachi High-Technologies Corporation, trade name: E-1045, target: Pt, electric current: 15 mA, 10 seconds); a cross sectional image of the specimen was then acquired using a scanning electron microscope (manufactured by Hitachi High-Technologies Corporation, trade name: S-4800TYPE I, accelerating voltage: 3.0 kv, emission current: 10 pA, working distance: 8 mm, detector: Mix); and the thickness was measured from this image.

Each of the layers composed of/comprised by the thermal transfer sheet according to the present invention will be described below.

(Substrate)

Any substrate may be used as long as it is a conventionally known one having a certain degree of thermal resistance and strength; and examples thereof include resin films such as polyethylene terephthalate (PET) films, 1,4-polycyclohexylene dimethylene terephthalate films, polyethylene naphthalate (PEN) films, polyphenylene sulfide films, polystyrene (PS) films, polypropylene (PP) films, polysulfone films, aramid films, polycarbonate films, polyvinyl alcohol films, cellulose derivatives such as cellophane and cellulose acetate, polyethylene (PE) films, polyvinyl chloride films, nylon films, polyimide films, and ionomer films.

The above substrate may be subjected to a surface treatment in order to improve adhesiveness to a neighboring layer. As the above surface treatment, known techniques for resin surface modification such as corona discharge treatment, flame treatment, ozone treatment, ultraviolet treatment, radiation treatment, surface roughening treatment, chemical treatment, plasma treatment, or grafting treatment can be applied. Among these surface treatments described above, corona treatment or plasma treatment is preferred in the present invention because of lower costs. One type of the above surface treatment may be solely carried out; or two or more types thereof may be carried out.

In addition, the substrate may as needed comprise an undercoat layer (a primer layer) on its one surface or both surfaces. The primer layer can be formed by coating. Further, the primer layer can also be formed, for example, by applying a primer liquid on an unstretched plastic film at the time of its deposition by melt extrusion melt extrusion and then carrying out stretching treatment.

Such a primer layer can be formed from, for example, the following organic materials and inorganic materials.

Examples of the organic material include polyester-based resins, polyurethane-based resins, (meta)acrylic resins, polyamide-based resins, polyether-based resins, polystyrene-based resins, polyvinyl-based resins, cellulose-based resins, and polyolefin-based resins.

Examples of the inorganic material include colloidal inorganic pigment ultrafine particles such as silica (colloidal silica), alumina or alumina hydrates (such as alumina sol, colloidal alumina, cationic aluminum oxides or hydrates thereof, pseudo boehmite), aluminum silicates, magnesium silicates, magnesium carbonate, magnesium oxide, and titanium oxide.

In addition to these, a polymer having an inorganic main chain that is formed from an organic titanate, for example, tetrakis (2-ethylhexyl)titanate, bis(ethyl-3-oxobutanolate-$0^1$,$0^3$)bis(2-propanolate)titanium, or isopropyl triisostearoyl titanate; or that is formed from a titanium alkoxide, for example, titanium tetra isopropoxide or titanium tetra-n-butoxide can be used as a material of the primer layer.

The thickness of the substrate is preferably not less than 2 μm and not more than 25 μm and more preferably not less than 3 μm and not more than 10 μm.

(Release Layer)

The release layer is disposed between the substrate and the colored layer and is a layer that is transferred, along with the colored layer, to a material on which a print is to be applied when heat transfer is carried out.

The release layer can contain, for example, a cellulose-based resin, a vinyl-based resin, a polyurethane-based resin, a silicone-based resin, a fluorine-based resin, silicone wax, or a fluorine modified resin or wax. Example of the wax include microcrystalline wax, carnauba wax, paraffin wax, Fischer-Tropsch wax, various low molecular weight polyethylenes, Japan wax, bee wax, spermaceti wax, insect wax, wool wax, shellac wax, Candelilla wax, petrolactam, partially modified waxes, esters of fatty acids, and fatty acid amides. Of these, use of carnauba wax allows better release from the substrate to be achieved and enables fine thin lines and the like to be cleanly released. Concurrently, the use allows the heat of the thermal head to be properly transferred to the colored layer and enables good transfer onto a material on which a print is to be applied to be achieved.

The thickness of the release layer is preferably not less than 0.4 μm and not more than 1.2 μm; and more preferably not less than 0.5 μm and not more than 1.0 μm. By adjusting the thickness of the release layer to the above range of numerical values, the printability to a material on which a print is to be applied having unevenness in its surface is able to be improved and concurrently the occurrence of tailing is able to be prevented.

The release layer can be formed by dissolving the above material, as needed, in an appropriate solvent such as acetone, methyl ethyl ketone, toluene, or xylene to obtain a coating liquid for release layer, applying this liquid onto a substrate by a commonly-used appropriate printing method or coating method such as gravure coater, roll coater, and wire bar, followed by heating and drying the resultant at a temperature of not less than 30° C. and not more than 80° C.

(Colored Layer)

The colored layer is a layer that is disposed on the release layer and contains a colorant and a polyester-based resin.

The colored layer preferably contains, as the polyester-based resin, the polyester-based resin A (hereinafter may in some cases be referred to as high molecular weight polyester-based resin) having a number average molecular weight (Mn) of not less than 15,000 and the polyester-based resin B (hereinafter may in some cases be referred to as low molecular weight polyester-based resin) having an Mn of not more than 5,000.

In this instance, the colored layer may contain two or more of kinds of the polyester-based resin A or may contain two or more of kinds of the polyester-based resin B.

The Mn of the polyester-based resin A is preferably not less than 15,000 and not more than 40,000 and further preferably not less than 15,000 and not more than 25,000.

The Mn of the polyester-based resin B is more preferably not less than 2,000 and not more than 5,000.

By the colored layer containing the polyester-based resin A and polyester-based resin B having the above Mn, the occurrence of tailing or the like at the time of heat transfer is able to be prevented and concurrently the resistance to organic solvents of the thermal transfer sheet is able to be further improved.

It is to be noted that Mn is a value obtained in terms of polystyrene by gel permeation chromatography (GPC) in accordance with ES K 7252-1 (2008).

In the present specification, a "polyester-based resin" means a polymer containing an ester group obtained by polycondensation of a polyvalent carboxylic acid with a polyalcohol; and examples thereof include PET, polyethylene isophthalate, polybutylene terephthalate, polypropylene terephthalate, polycyclohexanedimethylene terephthalate, and PEN.

Further, examples of the polyvalent carboxylic acid include terephthalic acid, isophthalic acid, phthalic acid, 2,6-naphthalene dicarboxylic acid, adipic acid, sebacic acid, decanedicarboxylic acid, azelaic acid, dodecadicarboxylic acid, and cyclohexanedicarboxylic acid.

Further, examples of the polyalcohol include ethylene glycol, propanediol, butanediol, pentanediol, hexanediol, neopentyl glycol, 1,4-cyclohexanedimethanol, decanediol, 2-ethyl-butyl-1-propanediol, and bisphenol A.

Further, the polyester-based resin may be one obtained by copolymerization of three or more kinds of the above polyvalent carboxylic acids and polyalcohols, or may be a copolymer thereof with a monomer or a polymer such as diethylene glycol, triethylene glycol, or polyethylene glycol.

Further in the present specification, the polyester-based resin also includes modified products thereof. Examples of the modified product of the polyester-based resin include urethane modified polyester-based resins.

The content ratio by mass of the polyester-based resin A to the polyester-based resin B (polyester-based resin A/polyester-based resin B) in the colored layer is preferably a ratio of not less than 2/3 and not more than 9/1. More preferably, the content ratio is a ratio of not less than 1/1 and not more than 4/1.

By the colored layer containing the polyester-based resin A and the polyester-based resin B at the above ratio, the occurrence of tailing or the like at the time of heat transfer is able to be prevented and concurrently the resistance to organic solvents of the thermal transfer sheet is able to be further improved.

The glass transition temperature (Tg) of the polyester-based resin is preferably not less than 20° C. and not more than 90° C. and more preferably not less than 50° C. and not more than 80° C.

By adjusting the Tg of the polyester-based resin contained to the colored layer in the above range of numerical values, the occurrence of blocking is able to be sufficiently eliminated or reduced while the transferability of the thermal transfer sheet is being well maintained.

It is to be noted that Tg can be determined based on measurement of changes in the amount of heat by DSC (differential scanning calorimetry) (DSC method) in accordance with JIS K 7121 (2012).

The content of the polyester-based resin in the colored layer is preferably not less than 30% by mass and not more than 90% by mass and more preferably not less than 40% by mass and not more than 70% by mass.

By adjusting the total content of the polyester-based resin contained to the colored layer in the above range of numerical values, the adhesion layer is able to more closely contact with the colored layer to thereby have improved resistance to organic solvents and improved rubfastness. In addition, high print density is able to be achieved.

The colored layer may contain another resin to the extent where effects of the present invention is not impaired. Examples of such a resin include acrylic resins, polyurethane-based resins, vinyl-based resins, cellulose-based resins, melamine-based resins, polyamide-based resins, polyolefin-based resins, and styrene-based resins.

From the viewpoint of achieving high resistance to organic solvents, the content of the other resin in the colored layer is preferably not more than 20% by mass and more preferably not more than 5% by mass. Most preferably, the colored layer has no other resins.

A colorant contained in the colored layer can be selected as appropriate, according to required tone of color, from carbon black, inorganic pigments, and organic pigments or dyes to be used. For example, particularly in the case of barcode printing, preferred are ones that have sufficient black color density and do not undergo change or fading of colors by light, heat or the like. Examples of such a colorant include carbon black such as lamp black, graphite, and nigrosine dyes. Further, in cases where color printing is required, dyes or pigments of other chromatic colors are used.

The colored layer may contain an additive such as an inorganic fine particle, an organic fine particle, a mold release agent, a dispersant, or an antistatic agent to the extent where effects of the present invention are not impaired.

The thickness of the colored layer is preferably not less than 0.2 μm and not more than 0.8 μm and more preferably not less than 0.3 μm and not more than 0.7 μm.

By adjusting the thickness of the colored layer to the above range of numerical values, its printability for fine lines and printability to a material on which a print is to be applied having unevenness on its surface are able to be improved while appropriate print density is being maintained.

The colored layer can be formed by dissolving the above material, as needed, in an appropriate solvent such as acetone, methyl ethyl ketone, toluene, or xylene to obtain a coating liquid for colored layer, applying this liquid onto a substrate by a commonly-used appropriate printing method or coating method such as gravure coater, roll coater, and wire bar, followed by heating and drying the resultant at a temperature of not less than 30° C. and not more than 80° C.

(Adhesion Layer)

The adhesion layer is provided on the colored layer and contains a polyester-based resin.

By the adhesion layer containing the polyester-based resin, the resistance to organic solvents of the thermal transfer sheet is able to be improved.

The Mn of the polyester-based resin contained in the adhesion layer is preferably not less than 2,000 and not more than 25,000 and more preferably not less than 3,000 and not more than 20,000.

By adjusting the Mn of the polyester-based resin contained in the adhesion layer to the above range of numerical values, the resistance to organic solvents and the rubfastness are able to be improved while the transferability of the thermal transfer sheet is being maintained.

In addition, the Tg of the polyester-based resin is preferably not less than 20° C. and not more than 90° C. and more preferably not less than 50° C. and not more than 80° C. By adjusting the Tg of the polyester-based resin to the above range of numerical values, the occurrence of blocking is able to be sufficiently eliminated or reduced while the transferability of the thermal transfer sheet is being well maintained.

The content of the polyester-based resin in the adhesion layer is preferably not less than 50% by mass and not more than 100% by mass and more preferably not less than 70% by mass and not more than 100% by mass.

By adjusting the content of the polyester-based resin to the adhesion layer in the above range of numerical values, the adhesiveness of the adhesion layer to a material on which a print is to be applied is able to be increased; and the adhesion layer is able to more closely contact with the colored layer. Thus, the resistance to organic solvents is able to be improved.

The adhesion layer may contain another resin to the extent where effects of the present invention are not impaired.

Examples of such a resin include acrylic resins, polyurethane-based resins, vinyl-based resins, cellulose-based resins, melamine-based resins, polyamide-based resins, polyolefin-based resins, and styrene-based resins.

The thickness of the adhesion layer is preferably not less than 0.1 μm and not more than 0.6 μm and more preferably not less than 0.2 μm and not more than 0.5 μm.

By adjusting the thickness of the adhesion layer to the above range of numerical values, the printability for fine lines is able to be improved.

The adhesion layer can be formed by dissolving the above material, as needed, in an appropriate solvent such as acetone, methyl ethyl ketone, toluene, or xylene to obtain a coating liquid for adhesion layer, applying this liquid onto a substrate by a commonly-used appropriate printing method or coating method such as gravure coater, roll coater, and wire bar, followed by heating and drying the resultant at a temperature of not less than 30° C. and not more than 80° C.

(Backing Layer)

In the present invention, the backing layer 5 is a layer that is if desired provided for the purpose of preventing negative effects such as the occurrence of sticking or creasing by heating from the back surface of the substrate (substrate's side on which the colored layer is not provided) when heat transfer is carried out. By providing the backing layer, the heat transfer can be carried out without causing the sticking even in a thermal transfer sheet having a plastic film which has poor thermal resistance as a substrate; and advantages such as hardness of being cut and ease of processing attributed to the plastic film can be utilized.

The backing layer can have a binder resin; and examples thereof include cellulose-based resins, styrene-based resin, vinyl-based resins, polyester-based, polyurethane-based resins, silicone modified urethane-based resins, fluorine modified urethane-based resins, and acrylic resins. Of these, styrene-based resin resins, to be specific, styrene-acrylonitrile copolymer resins are preferably used from the viewpoint of preventing burning and sticking of the thermal head with the backing layer and of preventing debris from being produced.

Further, a two-component curable resin that can be cured by using an isocyanate compound or the like may be contained as the binder resin. Examples of such a resin include polyvinyl acetal-based resins and polyvinyl butyral-based resins.

The isocyanate compound is not particularly restricted and conventionally known ones can be used. Of those, it is desirable to use adduct products of aromatic isocyanates. Examples of the aromatic polyisocyanate include 2,4-toluene diisocyanate, 2,6-toluene diisocyanate, or a mixture of 2,4-toluene diisocyanate and 2,6-toluene diisocyanate, 1,5-naphthalene diisocyanate, tolidine diisocyanate, p-phenylene diisocyanate, trans-cyclohexane-1,4-diisocyanate, xylylene diisocyanate, triphenylmethane triisocyanate, and tris(isocyanatephenyl)thiophosphate; and in particular, 2,4-toluene diisocyanate, 2,6-toluene diisocyanate, or a mixture of 2,4-toluene diisocyanate and 2,6-toluene diisocyanate is preferred.

In addition to the above component, an inorganic or organic fine particle may be added to the backing layer for auxiliary adjustment of lubricating properties. Examples of the inorganic fine particle include clay minerals such as talc and kaolin; carbonates such as calcium carbonate and magnesium carbonate; hydroxides such as aluminum hydroxide and magnesium hydroxide; sulfates such as calcium sulfate; oxides such as silica; and inorganic fine particles such as graphite, saltpeter, and boron nitride. Examples of the organic fine particle include organic resin fine particles composed of acrylic resins, Teflon (registered trademark) resin, silicone resins, lauroyl resins, phenol resins, acetal resins, polystyrene resins, nylon resins, or the like; or cross-linked resin fine particles obtained by reacting those with a cross linker. Among the above inorganic or organic fine particles, talc can be suitably used.

The thickness of the backing layer is preferably not less than 0.03 μm and not more than 1.0 μm and more preferably not less than 0.05 μm and not more than 0.5 μm. By adjusting the thickness of the backing layer within the above range of numerical values, negative effects such as the occurrence of sticking or creasing are able to be prevented while the heat transfer from the thermal head is being maintained to achieve sufficient print density.

The backing layer can be formed by dissolving the above material in an appropriate solvent such as acetone, methyl ethyl ketone, toluene, or xylene to obtain a coating liquid for backing layer, applying this liquid onto a substrate by a commonly-used appropriate printing method or coating method such as gravure coater, roll coater, and wire bar, followed by heating and drying the resultant at a temperature of not less than 30° C. and not more than 110° C.

(Other Layer)

In one embodiment, the thermal transfer sheet according to the present invention may comprise a mold release layer between the substrate and the release layer. The mold release layer is a layer that remains on the substrate when the heat transfer is carried out.

Further in one embodiment, the thermal transfer sheet according to the present invention may comprise an intermediate layer that improves adhesiveness between any layers.

Further in one embodiment, the thermal transfer sheet according to the present invention may comprise other layer such as a barrier layer between the release layer and the colored layer for the purpose of making it easier for the release layer or the colored layer to function. In this instance, in cases where the other layer contains a colorant such as a pigment, the thickness of the other layer is included in that of the colored layer when a ratio of the thickness of the release layer to the total thickness of the colored layer and the adhesion layer is calculated. Further, in cases where the other layer does not contain a colorant, the thickness of the other layer is included in that of the release layer when a ratio of the thickness of the release layer to the total thickness of the colored layer and the adhesion layer is calculated.

EXAMPLES

By way of example, the present invention will now be further described in detail; however the present invention is not limited to these examples. It is to be noted that, unless otherwise noted, the parts or % are by mass.

Example 1

To one surface of a PET film substrate sheet having a thickness of 4.5 μm that had been treated for improved adhesion, a coating liquid for backing layer having the below composition was applied such that an amount of coating was 0.3 g/m$^2$ in terms of the solid content, followed by drying to thereby form a backing layer. Note that the thickness of the backing layer was 0.3 μm.

<Coating Liquid for Backing Layer>

| | |
|---|---|
| Styrene-acrylonitrile copolymer resin | 11 parts |
| Linear saturated polyester-based resin | 0.3 parts |
| Zinc stearyl phosphate | 6 parts |
| Melamine resin powder | 3 parts |
| Methyl ethyl ketone | 80 parts |

Subsequently, to a portion of the other surface of the substrate sheet, which surface was opposed to the surface provided with the backing layer, a coating liquid for release layer having the below composition was applied such that an amount of coating on a dry basis was 0.6 g/m$^2$ in terms of the solid content, followed by drying to thereby form a release layer. Note that the thickness of the formed release layer was 0.6 μm.

<Coating Liquid for Release Layer>

| | |
|---|---|
| Carnauba wax | 100 parts |
| Water | 450 parts |
| IPA | 450 parts |

To the thus formed release layer, a coating liquid for colored layer having the below composition was applied such that an amount of coating on a dry basis is 0.45 g/m$^2$, followed by drying to thereby form a colored layer. A mixing ratio (A/B) of the high molecular weight polyester-based resin (A) to the low molecular weight polyester-based resin (B) was 1/1. Note that the thickness of the formed colored layer was 0.4 μm.

<Coating Liquid for Colored Layer>

| | |
|---|---|
| Carbon black | 33.4 parts |
| Polyester-based resin A | 33.3 parts (Mn: 17,000, Tg: 67° C.) |
| Polyester-based resin B | 33.3 parts (Mn: 3,000, Tg: 53° C.) |
| Toluene | 450 parts |
| Methyl ethyl ketone | 450 parts |

To the thus formed colored layer, a coating liquid for adhesion layer having the below composition was applied such that an amount of coating on a dry basis was 0.3 g/m$^2$, followed by drying to form an adhesion layer, thereby preparing a thermal transfer sheet. Note that the thickness of the formed adhesion layer was 0.3 μm.

In addition, the total thickness of the release layer, the colored layer, and the adhesion layer was 1.3 μm; and a ratio of the thickness of the release layer to the total thickness of the colored layer and the adhesion layer (the thickness of the release layer/(the thickness of the colored layer+the thickness of the adhesion layer)) was 6/7.

<Coating Liquid for Adhesion Layer>

| | |
|---|---|
| Polyester-based resin X | 100 parts (Mn: 5,000, Tg: 70° C.) |
| Water | 450 parts |
| IPA | 450 parts |

Example 2

A thermal transfer sheet was prepared in the same manner as described in Example 1 except that the mixed amount of the polyester-based resin A contained in the coating liquid for colored layer and the mixed amount of the polyester-based resin B was altered to 53.36 parts and 13.34 parts, respectively to allow the mixing ratio (A/B) of the high molecular weight polyester-based resin (A) to the low molecular weight polyester-based resin (B) to be 4/1.

Example 3

A thermal transfer sheet was prepared in the same manner as described in Example 1 except that the thickness of the adhesion layer was altered to 0.2 μm.

Note that the total thickness of the release layer, the colored layer, and the adhesion layer was 1.2 μm; and the ratio of the thickness of the release layer to the total thickness of the colored layer and the adhesion layer (the thickness of the release layer/(the thickness of the colored layer+the thickness of the adhesion layer)) was 1.

Example 4

A thermal transfer sheet was prepared in the same manner as described in Example 1 except that the thickness of the adhesion layer was altered to 0.4 μm.

Note that the total thickness of the release layer, the colored layer, and the adhesion layer was 1.4 μm; and the ratio of the thickness of the release layer to the total thickness of the colored layer and the adhesion layer (the thickness of the release layer/(the thickness of the colored layer+the thickness of the adhesion layer)) was 3/4.

Example 5

A thermal transfer sheet was prepared in the same manner as described in Example 1 except that the thickness of the release layer was altered to 1.0 μm.

Note that the total thickness of the release layer, the colored layer, and the adhesion layer was 1.7 μm; and the ratio of the thickness of the release layer to the total thickness of the colored layer and the adhesion layer (the thickness of the release layer/(the thickness of the colored layer+the thickness of the adhesion layer)) was 10/7.

Example 6

A thermal transfer sheet was prepared in the same manner as described in Example 1 except that the thickness of the release layer was altered to 0.5 μm.

Note that the total thickness of the release layer, the colored layer, and the adhesion layer was 1.2 μm; and the ratio of the thickness of the release layer to the total thickness of the colored layer and the adhesion layer (the thickness of the release layer/(the thickness of the colored layer+the thickness of the adhesion layer)) was 5/7.

Example 7

A thermal transfer sheet was prepared in the same manner as described in Example 1 except that the thickness of the colored layer was altered to 0.6 μm.

Note that the total thickness of the release layer, the colored layer, and the adhesion layer was 1.5 μm; and the ratio of the thickness of the release layer to the total thickness of the colored layer and the adhesion layer (the thickness of the release layer/(the thickness of the colored layer+the thickness of the adhesion layer)) was 2/3.

Example 8

A thermal transfer sheet was prepared in the same manner as described in Example 1 except that the thickness of the release layer was altered to 1.0 μm, that the thickness of the colored layer was altered to 0.8 μm, and that the thickness of the adhesion layer was altered to 0.2 μm.

Note that the total thickness of the release layer, the colored layer, and the adhesion layer was 2.0 μm; and that ratio of the thickness of the release layer to the total thickness of the colored layer and the adhesion layer (the thickness of the release layer/(the thickness of the colored layer+the thickness of the adhesion layer)) was 1.

Example 9

A thermal transfer sheet was prepared in the same manner as described in Example 1 except that the thickness of the colored layer was altered to 0.2 μm and that the thickness of the adhesion layer was altered to 0.4 μm.

Note that the total thickness of the release layer, the colored layer, and the adhesion layer was 1.2 μm; and the ratio of the thickness of the release layer to the total thickness of the colored layer and the adhesion layer (the thickness of the release layer/(the thickness of the colored layer+the thickness of the adhesion layer)) was 1.

Example 10

A thermal transfer sheet was prepared in the same manner as described in Example 1 except that the mixed amount of the polyester-based resin A contained in the coating liquid for colored layer and the mixed amount of the polyester-based resin B was altered to 26.68 parts and 40.02 parts, respectively to allow the mixing ratio (A/B) of the high molecular weight polyester-based resin (A) to the low molecular weight polyester-based resin (B) to be 2/3.

Example 11

A thermal transfer sheet was prepared in the same manner as described in Example 1 except that the mixed amount of the polyester-based resin A contained in the coating liquid for colored layer and the mixed amount of the polyester-based resin B was altered to 60.03 parts and 6.67 parts, respectively to allow the mixing ratio (A/B) of the high molecular weight polyester-based resin (A) to the low molecular weight polyester-based resin (B) to be 9/1.

Comparative Example 1

A thermal transfer sheet was prepared in the same manner as described in Example 1 except that the thickness of the release layer was altered to 1.2 μm.

Note that the total thickness of the release layer, the colored layer, and the adhesion layer was 1.9 μm; and the ratio of the thickness of the release layer to the total thickness of the colored layer and the adhesion layer (the thickness of the release layer/(the thickness of the colored layer+the thickness of the adhesion layer)) was 12/7.

Comparative Example 2

A thermal transfer sheet was prepared in the same manner as described in Example 1 except that the thickness of the release layer was altered to 0.4 μm.

Note that the total thickness of the release layer, the colored layer, and the adhesion layer was 1.1 μm; and the ratio of the thickness of the release layer to the total thickness of the colored layer and the adhesion layer (the thickness of the release layer/(the thickness of the colored layer+the thickness of the adhesion layer)) was 4/7.

Comparative Example 3

A thermal transfer sheet was prepared in the same manner as described in Example 1 except that the thickness of the release layer was altered to 1.1 μm, that the thickness of the colored layer was altered to 0.7 μm, and that the thickness of the adhesion layer was altered to 0.4 μm.

Note that the total thickness of the release layer, the colored layer, and the adhesion layer was 2.2 μm; and the ratio of the thickness of the release layer to the total thickness of the colored layer and the adhesion layer (the thickness of the release layer/(the thickness of the colored layer+the thickness of the adhesion layer)) was 1.

Comparative Example 4

A thermal transfer sheet was prepared in the same manner as described in Example 1 except that the thickness of the release layer was altered to 0.4 μm, that the thickness of the colored layer was altered to 0.3 μm, and that the thickness of the adhesion layer was altered to 0.2 μm.

Note that the total thickness of the release layer, the colored layer, and the adhesion layer was 0.9 μm; and the ratio of the thickness of the release layer to the total thickness of the colored layer and the adhesion layer (the thickness of the release layer/(the thickness of the colored layer+the thickness of the adhesion layer)) was 4/5.

Comparative Example 5

A thermal transfer sheet was prepared in the same manner as described in Example 1 except that the composition of the coating liquid for colored layer was altered as follows.

<Coating liquid for colored layer>

| | |
|---|---|
| Carbon black | 33.4 parts |
| Acrylic resin | 33.3 parts (Mn: 20,000, Tg: 100° C.) |
| Vinyl chloride-vinyl acetate copolymer | 33.3 parts (the degree of polymerization: 400, Tg: 70° C.) |
| Toluene | 450 parts |
| Methyl ethyl ketone | 450 parts |

TABLE 1

| | Release layer | | Colored layer | | | | | Adhesion layer | | | |
|---|---|---|---|---|---|---|---|---|---|---|---|
| | | | Composition (parts by mass) | | | | | Composition | | | |
| Table 1 | Composition (parts by mass) Carnauba wax | Thickness (μm) | Carbon black | Polyester-based resin A (Mn: 17000, Tg: 67° C.) | Polyester-based resin B (Mn: 3000, Tg: 53° C.) | A/B | Thickness (μm) | (parts by mass) Polyester-based resin X (Mn: 5000, Tg: 70° C.) | Thickness (μm) | Total thickness (μm) | Release layer/(Colored layer + Adhesion layer) |
| Example 1 | 100 | 0.6 | 33.4 | 33.3 | 33.3 | 1/1 | 0.4 | 100 | 0.3 | 1.3 | 6/7 |
| Example 2 | 100 | 0.6 | 33.3 | 53.36 | 13.34 | 4/1 | 0.4 | 100 | 0.3 | 1.3 | 6/7 |
| Example 3 | 100 | 0.6 | 33.4 | 33.3 | 33.3 | 1/1 | 0.4 | 100 | 0.2 | 1.2 | 1 |
| Example 4 | 100 | 0.6 | 33.4 | 33.3 | 33.3 | 1/1 | 0.4 | 100 | 0.4 | 1.4 | 3/4 |
| Example 5 | 100 | 1.0 | 33.4 | 33.3 | 33.3 | 1/1 | 0.4 | 100 | 0.3 | 1.7 | 10/7 |
| Example 6 | 100 | 0.5 | 33.4 | 33.3 | 33.3 | 1/1 | 0.4 | 100 | 0.3 | 1.2 | 5/7 |
| Example 7 | 100 | 0.6 | 33.4 | 33.3 | 33.3 | 1/1 | 0.6 | 100 | 0.3 | 1.5 | 2/3 |
| Example 8 | 100 | 1.0 | 33.4 | 33.3 | 33.3 | 1/1 | 0.8 | 100 | 0.2 | 2.0 | 1 |
| Example 9 | 100 | 0.6 | 33.4 | 33.3 | 33.3 | 1/1 | 0.2 | 100 | 0.4 | 1.2 | 1 |
| Example 10 | 100 | 0.6 | 33.3 | 26.68 | 40.02 | 2/3 | 0.4 | 100 | 0.3 | 1.3 | 6/7 |
| Example 11 | 100 | 0.6 | 33.3 | 60.03 | 6.67 | 9/1 | 0.4 | 100 | 0.3 | 1.3 | 6/7 |

TABLE 2

| | Release layer | | Colored layer | | | | | Adhesion layer | | | |
|---|---|---|---|---|---|---|---|---|---|---|---|
| | | | Composition (parts by mass) | | | | | Composition | | | |
| Table 2 | Composition (parts by mass) Carnauba wax | Thickness (μm) | Carbon black | Polyester-based resin A (Mn: 17000, Tg: 67° C.) | Polyester-based resin B (Mn: 3000, Tg: 53° C.) | A/B | Thickness (μm) | (parts by mass) Polyester-based resin X (Mn: 5000, Tg: 70° C.) | Thickness (μm) | Total thickness (μm) | Release layer/(Colored layer + Adhesion layer) |
| Comparative Example 1 | 100 | 1.2 | 33.4 | 33.3 | 33.3 | 1/1 | 0.4 | 100 | 0.3 | 1.9 | 12/7 |
| Comparative Example 2 | 100 | 0.4 | 33.4 | 33.3 | 33.3 | 1/1 | 0.4 | 100 | 0.3 | 1.1 | 4/7 |
| Comparative Example 3 | 100 | 1.1 | 33.4 | 33.3 | 33.3 | 1/1 | 0.7 | 100 | 0.4 | 2.2 | 1 |

TABLE 2-continued

| Table 2 | Release layer: Composition (parts by mass) Carnauba wax | Release layer: Thickness (μm) | Colored layer: Composition (parts by mass): Carbon black | Colored layer: Composition (parts by mass): Polyester-based resin A (Mn: 17000, Tg: 67° C.) | Colored layer: Composition (parts by mass): Polyester-based resin B (Mn: 3000, Tg: 53° C.) | Colored layer: A/B | Colored layer: Thickness (μm) | Adhesion layer: Composition (parts by mass) Polyester-based resin X (Mn: 5000, Tg: 70° C.) | Adhesion layer: Thickness (μm) | Total thickness (μm) | Release layer/(Colored layer + Adhesion layer) |
|---|---|---|---|---|---|---|---|---|---|---|---|
| Comparative Example 4 | 100 | 0.4 | 33.4 | 33.3 | 33.3 | 1/1 | 0.3 | 100 | 0.2 | 0.9 | 4/5 |
| Comparative Example 5 | 100 | 0.6 | 33.4 | Acrylic resin and Vinyl chloride-vinyl acetate copolymer were used. | | — | 0.4 | 100 | 0.3 | 1.3 | 6/7 |

The thermal transfer sheets obtained in Examples and Comparative Examples were subjected to the following tests to be evaluated. The evaluation results of each test are as shown in Table 3.

<<Printability for Fine Lines>>

Printing was performed one step at a time using a label printer Zebra 96XiIII (thermal head 600 dpi (dot per inch)) manufactured by Zebra Technologies as a printer at a print speed of 4 IPS (inch per second) with a print energy ranging from 20 to 30. Picket barcodes including fine lines with one-dot width (see FIG. 2) was printed as a print pattern using a silver PET label (manufactured by Avery Dennison, trade name: 72826) as a material on which a print is to be applied. The printed matter was visually evaluated. Evaluation criteria were as follows.

(Evaluation Criteria)

3: Fine line printing without faint print and collapsed print is able to be achieved with a print energy of not less than 2.

2: Fine line printing without faint print and collapsed print is able to be achieved with a print energy of 1.

1: No printable energy range is available; faint print or collapsed print occurs; and fine line printing is impossible.

<<Tailing>>

Printing was performed using a label printer TEC B-SX5T manufactured by Toshiba Tec Corporation as a printer at a print speed of 76.2 mm/sec (3 IPS) with a print energy of 0. Ladder barcodes (see FIG. 3) were printed using a white PET label (manufactured by Avery Dennison, trade name: 72825) as a material on which a print is to be applied.

The printed matter obtained by using the thermal transfer sheet of Examples and Comparative Examples was evaluated for the presence of tailing by using a barcode verifier Quick Check 850 (manufactured by Honeywell). Evaluation criteria were as follows.

(Evaluation Criteria)

3: There is no tailing and the result determined by the barcode verifier is A or B.

2: Tailing slightly occurs and the result determined by the barcode verifier is C or D.

1: Tailing occurs and the result determined by the barcode verifier is F or undeterminable.

<<Resistance to Organic Solvents (Resistance to IPA)>>

Picket barcodes (see FIG. 4) were printed on a white PET label (a material on which a print is to be applied, manufactured by Avery Dennison, trade name: 72825) using the thermal transfer sheet of Examples and Comparative Examples by Zebra 105SL printer (manufactured by Zebra Technologies). At that time, the print speed was set to 4 IPS; and the print energy was set to 26.

Subsequently, the surface of the printed matter was rubbed back and forth 100 times using a tester for color fastness to rubbing FR-2S type (manufactured by Suga Test Instruments Co., Ltd., one in accordance with a rubbing tester II type in JIS L 0849 (2013)) with cotton cloth saturated with 0.5 cc of isopropyl alcohol (IPA) with a load of 800 g.

The state of the surface of the printed matter after the rubbing was evaluated for resistance to organic solvents using a barcode verifier Quick Check 850 (manufactured by Honeywell); and evaluation criteria were as follows. Note that the evaluation for resistance to organic solvents was carried out after making sure if all the evaluation results by the barcode verifier before the rubbing was all a rating of A.

(Evaluation Criteria)

3: The result determined by the barcode verifier after the rubbing gives a rating of A.

2: The result determined by the barcode verifier after the rubbing gives a rating of B or C.

1: The result determined by the barcode verifier after the rubbing gives a rating of D or lower.

<<Printability to a Material on which a Print is to be Applied (Coated Paper) Having Unevenness>>

A print pattern (the same pattern as one used in the evaluation for tailing was used) was printed on a material on which a print is to be applied using the thermal transfer sheet of Examples and Comparative Examples, a coated paper label (manufactured by Avery, trade name: AW3209, smoothness 4300 (measurement apparatus: Oken type air-permeability and smoothness tester manufactured by Asahi Seiko Co., Ltd.)) as a material on which a print is to be applied, and Zebra 105SL printer (print speed 4 IPS, print energy 28). The printed barcode was then evaluated for the presence of occurrence of faint print by using a barcode verifier Quick Check 850 (manufactured by Honeywell). Evaluation criteria were as follows.

(Evaluation Criteria)

3: The result determined by the barcode verifier gives a rating of A.

2: The result determined by the barcode verifier gives a rating of B or C.

1: The result determined by the barcode verifier gives a rating of D or lower.

TABLE 3

| | Printability for fine lines | Tailing | Resistance to organic solvents | Printability to a material on which a print is to be applied having unevenness on its surface |
|---|---|---|---|---|
| Example 1 | 3 | 3 | 3 | 3 |
| Example 2 | 3 | 3 | 3 | 3 |
| Example 3 | 3 | 3 | 3 | 3 |
| Example 4 | 3 | 3 | 3 | 3 |
| Example 5 | 3 | 3 | 2 | 3 |
| Example 6 | 3 | 2 | 3 | 3 |
| Example 7 | 3 | 3 | 3 | 3 |
| Example 8 | 2 | 3 | 3 | 2 |
| Example 9 | 2 | 3 | 3 | 2 |
| Example 10 | 3 | 3 | 2 | 3 |
| Example 11 | 3 | 2 | 3 | 3 |
| Comparative Example 1 | 3 | 1 | 3 | 3 |
| Comparative Example 2 | 3 | 3 | 3 | 1 |
| Comparative Example 3 | 1 | 3 | 3 | 2 |
| Comparative Example 4 | 3 | 3 | 3 | 1 |
| Comparative Example 5 | 3 | 3 | 1 | 3 |

DESCRIPTION OF SYMBOLS

1 Substrate
2 Release layer
3 Colored layer
4 Adhesion layer
5 Backing layer
10 Thermal transfer sheet

What is claimed is:

1. A thermal transfer sheet comprising, in the order mentioned, a substrate, a release layer, a colored layer, and an adhesion layer, wherein said colored layer comprises a colorant and a polyester-based resin;

said adhesion layer comprises a polyester-based resin;

a ratio of the thickness of said release layer to the total thickness of said colored layer and said adhesion layer (the thickness of said release layer/(the thickness of said colored layer+the thickness of said adhesion layer)) is not less than 2/3 and not more than 3/2; and the total thickness of said release layer, said colored layer, and said adhesion layer is not less than 1.0 μm and not more than 2.0 μm.

2. The thermal transfer sheet according to claim 1, wherein the thickness of said colored layer is not less than 0.2 μm and not more than 0.8 μm.

3. The thermal transfer sheet according to claim 1, wherein said colored layer comprises polyester-based resin A having a number average molecular weight of not less than 15,000 and polyester-based resin B having a number average molecular weight of not more than 5,000.

4. The thermal transfer sheet according to claim 3, wherein a content ratio by mass of said polyester-based resin A to said polyester-based resin B (polyester-based resin A/polyester-based resin B) in said colored layer is not less than 2/3 and not more than 9/1.

5. The thermal transfer sheet according to claim 1, wherein the number average molecular weight of said polyester-based resin contained in said adhesion layer is not less than 2,000 and not more than 25,000.

* * * * *